US007878916B2

(12) United States Patent
Bissonnette

(10) Patent No.: US 7,878,916 B2
(45) Date of Patent: Feb. 1, 2011

(54) GOLF CLUB AND BALL PERFORMANCE MONITOR HAVING AN ULTRASONIC TRIGGER

(75) Inventor: Laurent C. Bissonnette, Portsmouth, RI (US)

(73) Assignee: Acushnet Company, Fairhaven, MA (US)

( * ) Notice: Subject to any disclaimer, the term of this patent is extended or adjusted under 35 U.S.C. 154(b) by 927 days.

(21) Appl. No.: 10/667,479

(22) Filed: Sep. 23, 2003

(65) Prior Publication Data

US 2005/0064948 A1 Mar. 24, 2005

(51) Int. Cl.
*A63B 57/00* (2006.01)

(52) U.S. Cl. ..... 473/131; 473/198; 473/199; 473/407; 473/409

(58) Field of Classification Search ..... 473/131, 473/136, 151, 198–199; 434/252
See application file for complete search history.

(56) References Cited

U.S. PATENT DOCUMENTS 4,136,687 A 1/1979 Dabroski
4,137,566 A 1/1979 Haas et al.
4,158,853 A 6/1979 Sullivan et al.
4,451,043 A * 5/1984 Ogawa et al. ..... 473/225
4,686,796 A * 8/1987 Giebmanns ..... 451/5
5,342,054 A * 8/1994 Chang et al. ..... 473/156
5,372,365 A * 12/1994 McTeigue et al. ..... 473/409
5,398,936 A * 3/1995 Kluttz et al. ..... 473/156
5,447,314 A * 9/1995 Yamazaki et al. ..... 473/353
5,464,208 A * 11/1995 Pierce ..... 473/451
5,471,383 A 11/1995 Gobush et al.
5,501,463 A 3/1996 Gobush et al.
5,575,719 A 11/1996 Gobush et al.
5,681,993 A * 10/1997 Heitman ..... 73/379.02
5,697,791 A * 12/1997 Nashner et al. ..... 434/247
5,797,805 A * 8/1998 Lubell et al. ..... 473/266
5,803,823 A 9/1998 Gobush et al.
5,904,484 A * 5/1999 Burns ..... 434/252
5,982,352 A * 11/1999 Pryor ..... 345/156
5,984,684 A * 11/1999 Brostedt et al. ..... 434/252

(Continued)

FOREIGN PATENT DOCUMENTS

JP 60-186771 12/1985

(Continued)

OTHER PUBLICATIONS

Ermert et al., "A new concept for a Real-Time Ultrasound Transmission Camera", IEEE Ultrasonics Symposium, 2000, see entire document.*

(Continued)

*Primary Examiner*—John M Hotaling, II
*Assistant Examiner*—Ryan Hsu
(74) *Attorney, Agent, or Firm*—Hanify & King, P.C.

(57) ABSTRACT

An ultrasonic trigger for a golf equipment performance monitor is described. In a preferred embodiment, the ultrasonic trigger comprises at least one emitter and receiver. The emitters periodically generate sound waves at an ultrasonic frequency. The sound waves are targeted towards an object or objects within a target area. The sound waves are reflected by the objects within the target area, and are detected by at least one receiver. The receiver may be connected to a computational device to determine the position and/or velocity of the objects within the field of view.

21 Claims, 5 Drawing Sheets

U.S. PATENT DOCUMENTS

| | | | | |
|---|---|---|---|---|
| 5,993,323 | A * | 11/1999 | Linenfelser | 473/209 |
| 6,041,651 | A * | 3/2000 | Naruo et al. | 73/491 |
| 6,042,483 | A | 3/2000 | Katayama | |
| 6,241,622 | B1 | 6/2001 | Gobush et al. | |
| 6,285,445 | B1 | 9/2001 | Winfield et al. | |
| 6,286,364 | B1 * | 9/2001 | Aoyama et al. | 73/65.03 |
| 6,390,934 | B1 | 5/2002 | Winfield et al. | |
| 6,431,990 | B1 | 8/2002 | Manwaring | |
| 6,458,035 | B1 | 10/2002 | Katayama | |
| 6,465,986 | B1 * | 10/2002 | Haba | 320/116 |
| 6,488,591 | B1 | 12/2002 | Gobush et al. | |
| 6,500,073 | B1 | 12/2002 | Gobush et al. | |
| 6,506,124 | B1 | 1/2003 | Manwaring et al. | |
| 6,523,964 | B2 * | 2/2003 | Schofield et al. | 359/601 |
| 6,533,674 | B1 | 3/2003 | Gobush | |
| 6,561,917 | B2 | 5/2003 | Manwaring | |
| 6,579,190 | B2 | 6/2003 | Yamamoto | |
| 6,983,637 | B2 * | 1/2006 | Nesbit et al. | 73/12.02 |
| 2004/0032970 | A1 * | 2/2004 | Kiraly | 382/103 |

FOREIGN PATENT DOCUMENTS

| | | |
|---|---|---|
| JP | 03-251276 | 11/1991 |
| JP | 2001042391 | 6/2000 |
| JP | 2001-042391 | 2/2001 |
| JP | 2001-074837 | 3/2001 |
| JP | 2001-264016 | 9/2001 |
| JP | 2002-071802 | 3/2002 |
| JP | 2002071802 | 3/2002 |
| JP | 2002248189 | 9/2002 |
| JP | 2003-26065 | 1/2003 |
| WO | WO 01/14982 | 3/2001 |

OTHER PUBLICATIONS

Wikipedia, "Ultrasound", Mar. 30, 2007 [retrieved Mar. 31, 2007 from http://en.wikipedia.org/wiki/Ultrasound], www.Wikipedia.com , see entire document.*

Wikipedia, "Frequency", Mar. 30, 2007 [retrieved Mar. 31, 2007 from http://en.wikipedia.org/wiki/Frequency], www.Wikipedia.com, see entire document.*

Japanese Office Action dated Jun. 1, 2010 of corresponding Japanese Patent Application No. 2004-275438.

* cited by examiner $\Theta_2 > \Theta_1$

GOLF CLUB AND BALL PERFORMANCE MONITOR HAVING AN ULTRASONIC TRIGGER

FIELD OF THE INVENTION

The present invention relates to a device that is capable of measuring the kinematics of a golf club and golf ball. More specifically, the present invention relates to an ultrasonic triggering device that is capable of determining the position and velocity of a club and/or ball in motion.

BACKGROUND OF THE INVENTION

Performance monitors that measure the kinematics of a golf club and ball, such as those described by U.S. Pat. Nos. 6,533,674 and 6,500,073, are well known in the art. The most sophisticated of these devices utilize digital imaging devices to optically acquire spatial information of the golf clubs and balls. To determine kinematics, at least two time spaced images which contain spatial information must be acquired.

Performance monitors typically use an optical system to acquire the time spaced images. The optical systems generally have a fixed field of view, and therefore a triggering system is required to activate image acquisition as the ball or club enters the field of view. This may be complicated by the fact that the club velocity may vary. For example, a pitching wedge may move at approximately 40 mph, while a driver may move at about 120 mph. Since the velocity of the ball or club may vary dramatically, the time interval between consecutive images must be controlled to ensure that at least two images are acquired within the field of view.

Typically, this has been accomplished by using a trigger sensor that determines the spatial position and velocity of the club or ball. The trigger sensor is then attached to a computational device, such as a microprocessor or an electronic gate array, to compute activation times for the imaging system.

Prior art devices have used a sensor consisting of a pair of lasers to determine position and velocity. One such laser sensor is described by U.S. Pat. No. 6,561,917. However, laser devices have several deficiencies. Primarily, they are susceptible to interference from sunlight. This can cause errors, which may lead to an incorrect dwell time. Additionally, they may also require reflectors for long range operation, may require separate emitter and receiver bodies, are expensive, and may pose a safety risk. These deficiencies make laser sensors obtrusive to the golfer, and present the operator of the performance monitor with added burden.

A continuing need exists for an accurate, inexpensive triggering system that is not susceptible to outside interference.

SUMMARY OF THE INVENTION

The present invention relates to a performance monitor having a camera and an ultrasonic trigger. The ultrasonic trigger may have one or more ultrasonic emitters that are capable of emitting sound waves towards an object or objects in a target area. The sound waves are emitted periodically, and travel towards the target area. Once the sound waves reach an object within the target area, they strike the object and are reflected. One or more receivers are positioned such that they can detect and receive the reflected sound waves. Once the reflected sound waves are received, they may be analyzed to determine kinematic characteristics of the golf club and golf ball, such as velocity, spatial position, and the like. These characteristics may be used to compute activation times for image acquisition equipment.

In a preferred embodiment, the present invention comprises an ultrasonic trigger. The ultrasonic trigger includes an ultrasonic trigger sensor. An imaging device is operatively connected to the ultrasonic trigger sensor to determine the kinematics of one or more objects. The objects may include, but are not limited to, one or more golf clubs and golf balls.

In a preferred embodiment, the ultrasonic trigger emits sound waves having a frequency between about 10 and about 500 KHz. More preferably, the sound waves have a frequency between about 100 and about 200 KHz. The sound waves may be focused over an area of sonification. Preferably, the area of sonification comprises a substantially circular area having a diameter of between about 6 inches and about two feet. The ultrasonic trigger may also comprise a beam angle. Preferably, the beam angle is between about 1 and about 30 degrees. More preferably, the beam angle is between about 5 and about 15 degrees.

The sound waves that are emitted by the ultrasonic trigger are preferably emitted periodically, as pulses. The pulses preferably have a duration of between about 10 and about 200 microseconds. The time period between the pulses is preferably between about 100 and about 5000 microseconds.

In another preferred embodiment, the present invention comprises a golf ball and golf club performance monitor, having the properties described above with respect to the ultrasonic trigger.

The present invention also comprises an ultrasonic triggering method. The method comprises the steps of emitting a plurality of ultrasonic sound waves towards a target area. An imaging system is then activated to determine the kinematics of at least one object within the target area. The other aspects of the invention, including the frequency of the ultrasonic waves, the area of sonification, and the pulse duration are all substantially the same as the description above.

DETAILED DESCRIPTION OF THE PREFERRED EMBODIMENTS

Figure 1:
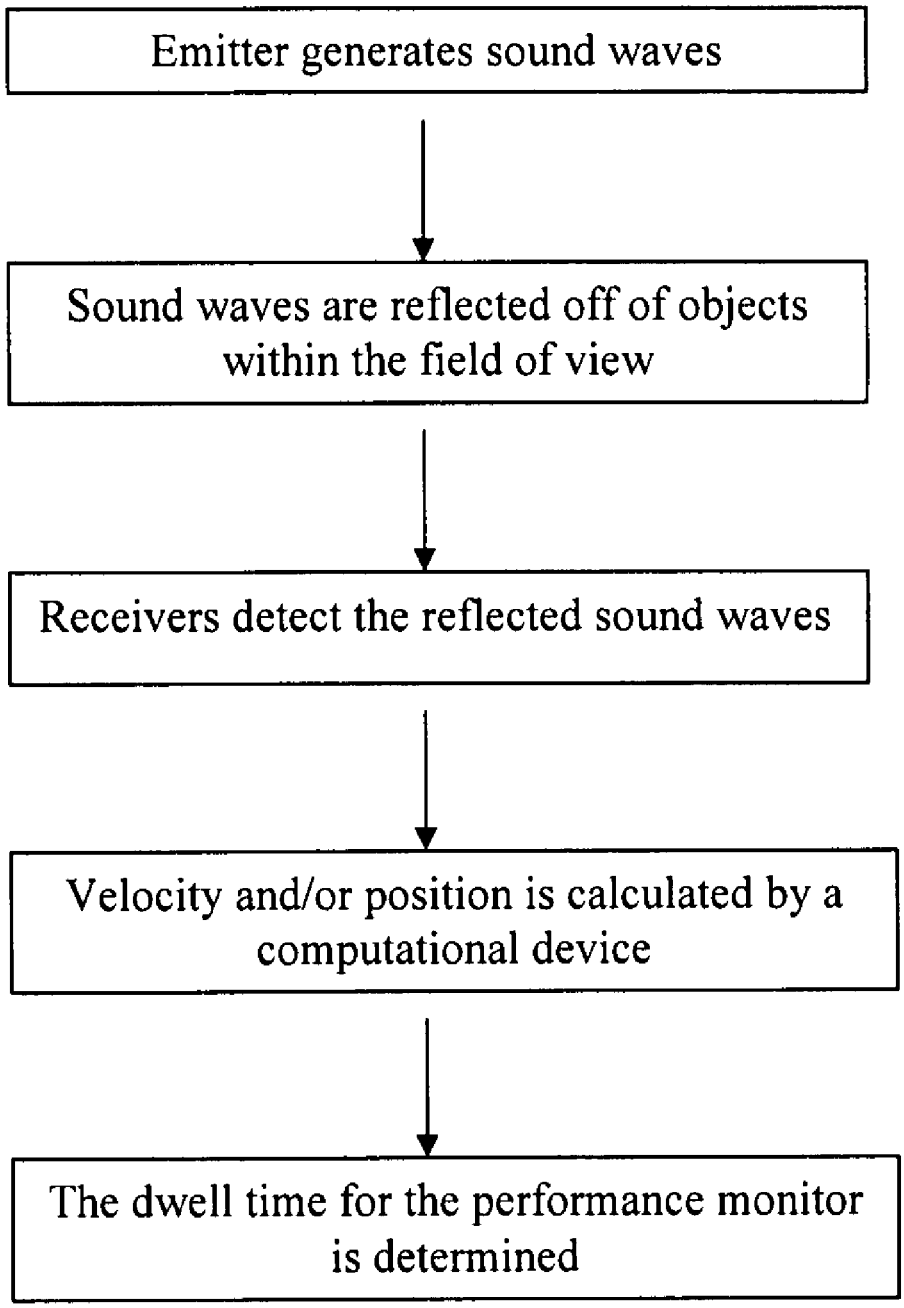
FIG. 1 is a diagram showing exemplary steps according to the present invention.

The present invention relates to a performance monitor having a camera and an ultrasonic trigger. The ultrasonic trigger may have one or more ultrasonic emitters that are capable of emitting sound waves towards an object or objects in a target area. The sound waves are emitted periodically, and travel towards the target area. Once the sound waves reach an object within the target area, they strike the object and are reflected. One or more receivers are positioned such that they can detect and receive the reflected sound waves. Once the reflected sound waves are received, they may be analyzed to determine kinematic characteristics of the golf club and golf ball, such as velocity, spatial position, and the like. These characteristics may be used to compute activation times for image acquisition equipment.

The emitter and receiver are preferably operatively connected, or combined, so that the device is less burdensome and obtrusive to a player. The one or more combined emitters and receivers are capable of functioning without the assistance of secondary reflectors. In other words, the present invention does not require any additional apparatus to focus the reflected sound waves towards the receivers. The present invention is capable of more reliably determining position and velocity of a golf club or golf ball based solely on the reflected waves without the need for additional equipment. This allows the combined emitter/receivers to be placed at a desired distance away from a player, which gives the player a more realistic, open area, in which to swing.

The frequency of the emitted sound waves may be selected so that the likelihood of interference from extraneous sources, such as ambient sound and the like, is eliminated or substantially reduced. Preferably, the emitted sound waves have a frequency that is not susceptible to outside interference. Having waves that are not susceptible to outside interference aids in allowing the receivers to function without secondary reflectors, as described above.

In a preferred embodiment, the present invention comprises an ultrasonic triggering device that may be used in conjunction with a device that measures the kinematics of a golf club and golf ball. A preferred embodiment of the present invention provides an ultrasonic transducer that periodically emits sound waves and receives echoes. The sound waves and the received echoes may be used to determine the position and velocity of a golf club and/or golf ball. The use of sound waves prevents substantially all outside interference from interfering with the measurements.

Devices that measure the kinematics of a golf club and golf ball typically have a fixed field of view, or target area. Thus, these devices require a triggering system to activate image acquisition equipment while the golf club and golf ball are within the target area. The present invention functions as a triggering system that can be adapted to work with any type of device that measures the kinematics of an object. The present invention allows the image acquisition equipment to accurately determine the dwell time between two or more images.

In one aspect of a preferred embodiment, the present invention may be used with any type of golf equipment performance monitor. It may be placed in any orientation, which may be determined according to a particular application.

In one embodiment, the present invention comprises at least one combined ultrasonic emitter and receiver. The number of combined emitters/receivers may vary according to a particular application. In a preferred embodiment, two combined emitters/receivers are employed to facilitate left and right handed golfers. Thus, one of the combined emitter/receivers is selectively positioned such it is able to direct ultrasonic waves towards the equipment of a left handed player, while another is selectively positioned such that is able to direct ultrasonic waves towards the equipment of a right handed player.

In another embodiment, one emitter/reciever is used. The emitter/reciever may be selectively positioned towards a central point of the performance monitor, such that it can be aimed left or right to accommodate left or right handed players. Alternately, the one emitter/reciever may have a beam angle that is wide enough to accommodate both left and right handed players, as will be discussed in more detail below.

In a preferred embodiment, any type of combined emitter and receiver may be used. Alternately, a different emitter and receiver may be combined or operatively connected. Any type of emitter known to those skilled in the art may be used. In a preferred embodiment, the emitter is capable of emitting sound waves in the ultrasonic frequency range, which is between about 10 and about 500 KHz. In one preferred embodiment, the frequency is about 100 KHz. Those skilled in the art will recognize that the pulse duration and pulse frequency of the emitters may be altered according to a particular application.

Any type of receiver known to those skilled in the art may be used. In some embodiments, the type of receiver may depend on the type of emitter that is employed. In other embodiments, the type of receiver may depend on the operating frequency of the emitters.

In some embodiments, the number of combined emitters/receivers may be based on the size of the area that is being observed. In embodiments that have a larger area of observation, it may be desirable to have a larger number of emitters/receivers in order to detect reflected sound waves. In embodiments that have a smaller area of observation, fewer emitters/receivers may be necessary to obtain desired information.

In an exemplary embodiment, the method according to the present invention comprises sound waves being emitted by one or more emitters. Referring to FIG. 1, the sound waves are preferably focused towards a predetermined target area. The size of the area may be determined by the types of objects being used in a particular application. In a preferred embodiment, the area should be large enough for a player to swing a golf club.

Preferably, the sound waves are emitted at any desired frequency. The frequency of the sound waves may depend on the distance between the target area and the emitters and/or receivers. In a preferred embodiment, the frequency of the sound waves may be between 10 KHz and 500 KHz. More preferably, the frequency is between 50 KHz and 200 KHz.

In a preferred embodiment, the sound waves are emitted periodically, as one or more pulses. Emitting sound waves with a known periodicity enables calculation of velocity. The variation between the emitted period and echo period enables calculation of position and velocity. In other embodiments, the emitters may produce sound waves continuously. As will be appreciated by those skilled in the art, the sound waves may be emitted periodically or continuously, depending on a particular application.

Figure 3:
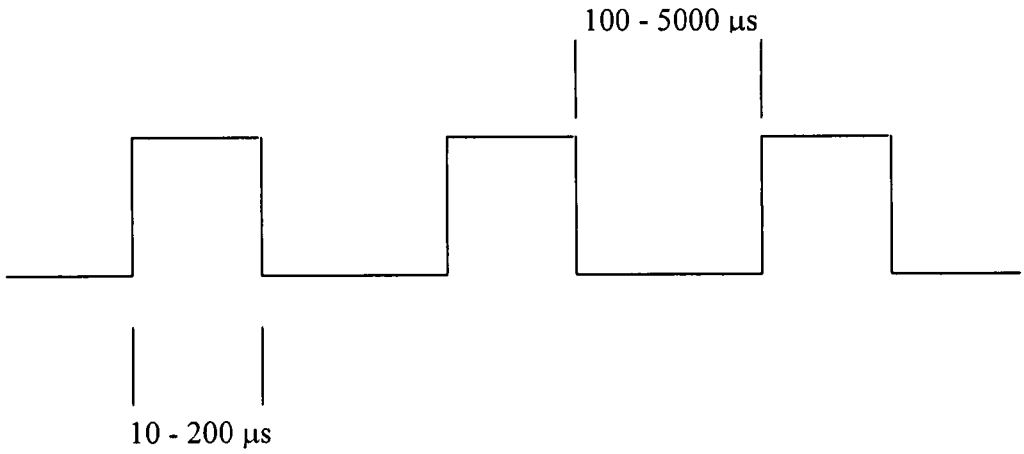
FIG. 3 is an illustration of the pulse duration and the time interval between pulses.

FIG. 3 illustrates that the duration of the pulse and the duration of the time period between the pulses may be varied. In one embodiment, each pulse that is emitted has the same duration. Similarly, the time period between the pulses also has the same duration. However, in another embodiment, the duration of the pulse and the time period between the pulses may be varied.

Preferably, the duration of each pulse is between about 10 and about 200 microseconds. More preferably, the duration of each pulse is between about 50 and about 100 microseconds. The period between the pulses is preferably between about 100 and about 5000 microseconds. More preferably, the period between the pulses is between about 500 and about 2000 microseconds.

Figure 4A:
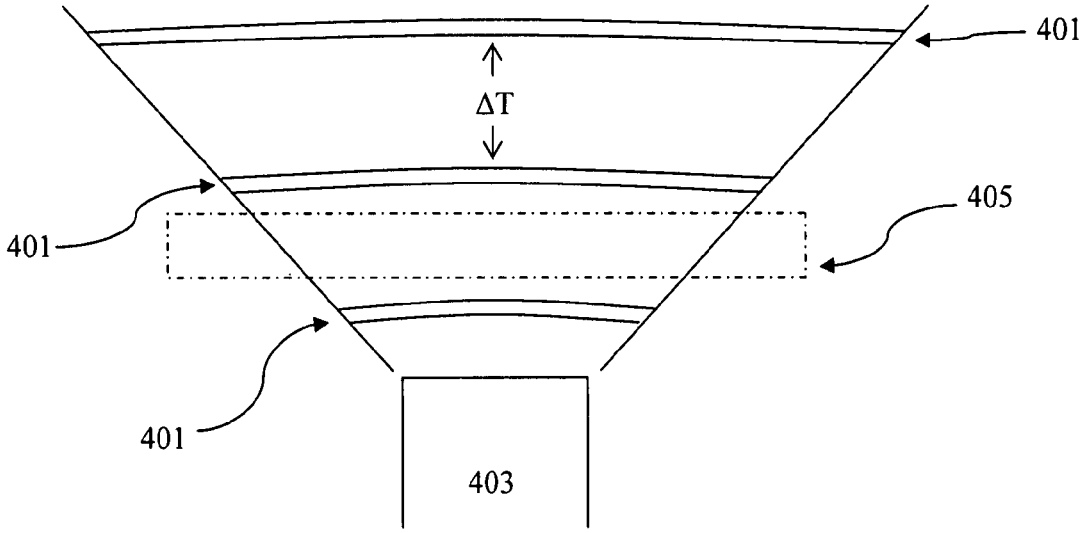
FIGS. 4A and 4B are illustrations showing the time interval between consecutive pulses.

FIG. 4A is another illustration that shows exemplary pulses 401 that are generated by the ultrasonic trigger 403. The illustration shows a series of pulses, separated by a predetermined time interval, travelling through space when there are no objects within the target area 405. The duration of the pulses and the period between the pulses can be varied, as described above. After a pulse is generated by the ultrasonic trigger 403, it travels towards the target area 405. When one or more objects are present within the target area 405, the pulse strikes the object and is reflected back towards the ultrasonic trigger 403. However, in the absence of objects within the target area 405, the each pulse will continue into space.

Figure 4B:
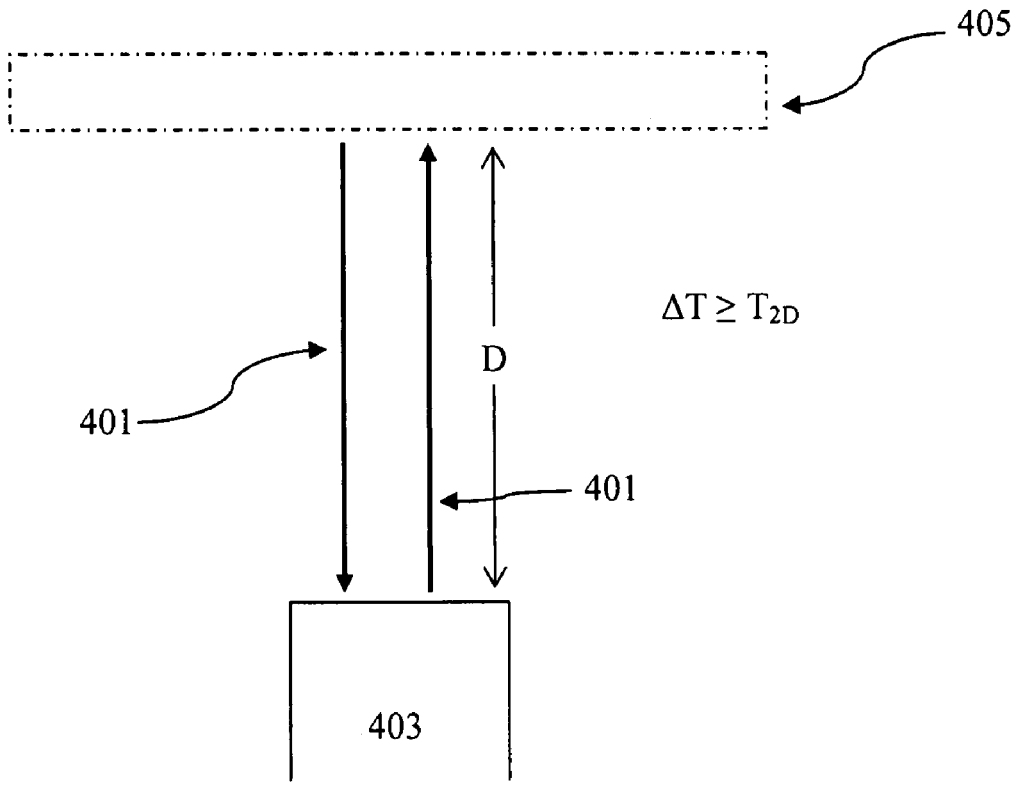

In one embodiment, the time interval between the pulses may be varied to prevent interference between waves that are emitted by the ultrasonic trigger 403, and waves that are reflected by objects within the target area 405. Referring to FIG. 4B, a pulse 401 is emitted from the ultrasonic trigger 403. The pulse 401 then travels a distance D, and then strikes the objects within the field of view 405. The pulse then reflects off the objects and returns to the ultrasonic trigger 403 over substantially the same distance D. To avoid interference between an emitted pulse and a reflected pulse, the time interval between consecutive pulses may be greater than or equal to the time that it takes for a pulse to travel twice the distance (2D) from the trigger 403 to the field of view 405.

In a preferred embodiment, the sound waves may be directed towards one or more points within a target area. For example, in an embodiment that is measuring the position or velocity of a golf club, it may be desirable to have the sound waves directed towards different points along the path of the swing. As will be appreciated by those skilled in the art, the sound waves may be directed to any number of points.

The target area may be any desired distance away from the combined emitters and receivers. The distance of the target area from the emitters and receivers may depend on several factors, such as the frequency of the sound waves. The distance may be chosen to minimize the distortion of the sound waves through the air.

Preferably, the target area is between 5 and 10 feet away from the combined emitters and receivers. More preferably, the target area is between 1 and 5 feet away, and most preferably the target area is between 1 and 4 feet away from the combined emitters and receivers.

Figure 2:
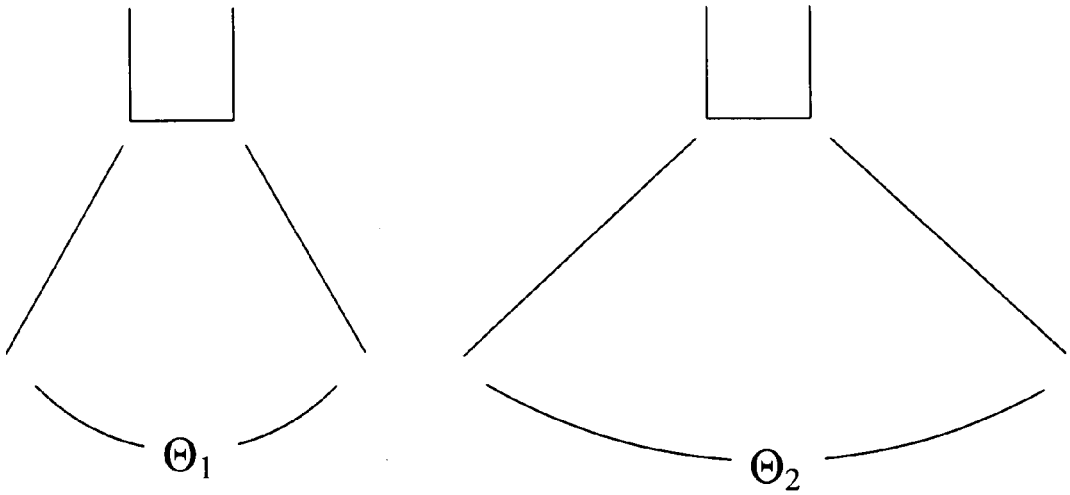
FIG. 2 is an illustration of various beam angles of the present invention.

As previously discussed, preferred embodiments of the present invention may use one or two emitters/receiver. In each of these preferred embodiments, the beam angle of each emitter/receiver 201 may vary, as shown in FIG. 2. Preferably, the beam angle is between 1 and 30 degrees. More preferably, the beam angle is between 5 and 15 degrees.

Alternately, in other embodiments, an emitter/receiver preferably emits ultrasonic waves over an area of sonification. Preferably, the area of sonification is a substantially circular area having a diameter between about 6 inches and about 2 feet. More preferably, the area of sonification is a substantially circular area having a diameter between about 1 foot and about 2 feet.

Once the sound waves are emitted to one or more desired points, at least a portion of the emitted waves will be reflected by the objects in the target area. Other portions of the emitted sound waves may not hit an object, and may continue into space until they dissipate. In a preferred embodiment, the reflected sound waves are received by a plurality of receivers. The plurality of receivers may receive reflected waves for every pulse that is generated by the emitters.

The combined emitters/receivers may be connected to any type of computing device. The computing device may comprise one or more microprocessor, electronic gate, or the like. In a preferred embodiment, the output of the receivers is analyzed to determine various characteristics of the movement of the golf club and golf ball. The position and velocity of the objects are among the characteristics that may be computed. In other embodiments, other desired characteristics may be computed.

In one embodiment, the present invention determines the position and velocity of the objects and then sends this information to a computing device, such as a processor or the like. In one embodiment, the computing device is operatively connected to the imaging device. Based on the position and velocity of the objects, the computing device is able to determine the necessary dwell time between consecutive images. Based on position and velocity information from the present invention, the computing device may also control other aspects of the imaging device, such as the number of images, exposure time for each image or its equivalent for digital cameras, or the like.

Though the present invention has been described with respect to a golf club and a golf ball, those skilled in the art will recognize that other embodiments according to the present invention may be adapted to use any type or number of objects. Such objects may include, but are not limited to, a baseball bat or ball, or a hockey stick or puck. The size and shapes of the objects may be changed as desired. Additionally, other kinematic properties of the objects, other than position and velocity may be measured, as required by a particular application.

Although the present invention has been described with reference to particular embodiments, it will be understood to those skilled in the art that the invention is capable of a variety of alternative embodiments within the spirit of the appended claims.

The invention claimed is:

1. An imaging system for determining the kinematics of an object swung by a player, comprising:

an ultrasonic trigger positioned in front of a target area through which an object passes, operable to determine the movement of the object, wherein the ultrasonic trigger comprises at least one emitter and at least one receiver, and wherein the movement of the object comprises the velocity and spatial position of the object;

a computing device operatively connected to the ultrasonic trigger and operable to receive the velocity and spatial position of the object;

an imaging device operatively connected to the computing device and operable to capture consecutive optical images of the object, wherein the imaging device receives a dwell time and number of consecutive optical images based on the movement of the object;

wherein the ultrasonic trigger emits sound waves periodically using pulses, and a time period between the pulses is greater than or equal to twice a distance from the ultrasonic trigger to the target area.

2. The imaging device according to claim 1, wherein the object comprises at least one of a golf ball and a golf club.

3. The imaging device according to claim 1, wherein the ultrasonic trigger emits sound waves having a frequency between about 10 and about 500 KHz.

4. The imaging device according to claim 1, wherein the ultrasonic trigger emits sound waves having a frequency between about 100 and about 200 KHz.

5. The imaging device according to claim 1, wherein the ultrasonic trigger emits ultrasonic waves over an area of sonification that is substantially circular and has a diameter of between about 6 inches and about 2 feet.

6. The imaging device according to claim 1, wherein the ultrasonic trigger emits ultrasonic waves having a beam angle that is between about 1 and about 30 degrees.

7. The imaging device according to claim 6, wherein the beam angle is between about 5 and about 15 degrees.

8. The imaging device according to claim 1, wherein the periodic sound waves comprise pulses having a duration between about 10 and about 200 microseconds.

9. A system for simultaneously measuring kinematics of a golf club and a golf ball during a golfer's striking of a golf ball, the system comprising:

a first camera and a second camera, each of the first and second cameras focused toward a predetermined field of view;

a golf club having at least one optical marker;

a golf ball within the predetermined field of view; and an ultrasonic trigger positioned in front of a target area through which a golf club passes, the ultrasonic trigger emitting periodic ultrasonic pulses along a path of a golf club swing, wherein a time period between the periodic ultrasonic pulses is greater than or equal to twice the distance from the ultrasonic trigger to a target area;

a computing device that is operatively connected to the ultrasonic trigger and estimates the golf club speed based on output from the ultrasonic trigger, wherein the first and second cameras capture optical images of at least one of the golf ball and golf club based on the estimated golf club speed.

10. The system according to claim 9, wherein the ultrasonic trigger emits sound waves having a frequency between about 10 and about 500 KHz.

11. The system according to claim 9, wherein the ultrasonic trigger emits ultrasonic waves over an area of sonification that is substantially circular and has a diameter of between about 6 inches and about 2 feet.

12. The system according to claim 9, wherein the ultrasonic waves have a beam angle that is between about 1 and about 30 degrees.

13. The system according to claim 9, wherein the ultrasonic trigger emits sound waves periodically.

14. The system according to claim 13, wherein the periodic sound waves comprise pulses having a duration between about 10 and about 200 microseconds.

15. The system according to claim 13, wherein the periodic sound waves comprise pulses, wherein the time period between the pulses is between about 100 and about 5000 microseconds.

16. An imaging system for determining the kinematics of an object swung by a player, comprising:

an ultrasonic trigger comprising an emitter and a receiver, wherein the emitter is positioned in front of a path of motion of an object and emits ultrasonic waves along the path of motion of the object, and wherein the ultrasonic trigger determines the position and velocity of the object;

a computing device operatively connected to the ultrasonic trigger that calculates a dwell time for consecutive optical images based on the position and velocity of the object; and an imaging device operatively connected to the computing device that captures consecutive optical images of one or more objects based on the dwell time;

wherein the ultrasonic trigger is positioned to determine the movement of an object swung by a left or right handed player; and wherein the ultrasonic trigger emits periodic ultrasonic pulses along a path of a golf club swing, wherein a time period between the periodic ultrasonic pulses is greater than or equal to twice a distance from the ultrasonic trigger to a target area.

17. The imaging system of claim 16, wherein the ultrasonic waves have a beam angle that is between about 1 and about 30 degrees.

18. The imaging device of claim 17, wherein the beam angle is between about 5 and about 15 degrees.

19. The imaging device of claim 16, wherein the ultrasonic waves comprise pulses having a duration between about 10 and about 200 microseconds.

20. The imaging device of claim 16, wherein the ultrasonic waves comprise pulses having a time period between the pulses of about 100 to about 5000 microseconds.

21. The imaging device of claim 1, further comprising a single ultrasonic trigger.

* * * * *